US010872711B2

(12) United States Patent
Kohori et al.

(10) Patent No.: US 10,872,711 B2
(45) Date of Patent: Dec. 22, 2020

(54) CABLE HAVING A TWISTED PAIR ELECTRONIC WIRE AND A RELEASE LAYER

(71) Applicant: SUMITOMO ELECTRIC INDUSTRIES, LTD., Osaka (JP)

(72) Inventors: Takaya Kohori, Kanuma (JP); Hiroyuki Okawa, Kanuma (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/635,525

(22) PCT Filed: Apr. 27, 2018

(86) PCT No.: PCT/JP2018/017302
§ 371 (c)(1),
(2) Date: Jan. 30, 2020

(87) PCT Pub. No.: WO2019/026365
PCT Pub. Date: Feb. 7, 2019

(65) Prior Publication Data

US 2020/0258659 A1 Aug. 13, 2020

(30) Foreign Application Priority Data

Aug. 1, 2017 (JP) ..... 2017-149203

(51) Int. Cl.
*H01B 7/22* (2006.01)
*H01B 1/02* (2006.01)
(Continued)

(52) U.S. Cl.
CPC ..... *H01B 7/223* (2013.01); *H01B 1/026* (2013.01); *H01B 3/308* (2013.01); *H01B 7/0876* (2013.01)

(58) Field of Classification Search
CPC ..... H01B 7/223; H01B 1/026; H01B 3/308; H01B 7/0876
(Continued)

(56) References Cited

U.S. PATENT DOCUMENTS 1,691,869 A * 11/1928 Fowle ..... H01B 5/08 174/128.1
3,240,570 A * 3/1966 Grimes, Jr. ..... D07B 1/0673 57/214
(Continued)

FOREIGN PATENT DOCUMENTS

CN 204792056 U 11/2015
CN 106029930 A 10/2016
(Continued)

OTHER PUBLICATIONS

Calmont Wire and Gage www.calmont.com (Year: 2010).*

*Primary Examiner* — Timothy J Thompson
*Assistant Examiner* — Michael F McAllister
(74) *Attorney, Agent, or Firm* — Oliff PLC

(57) ABSTRACT

An electronic wire and a cable which are excellent in bending resistance even when a diameter is small. The electronic wire has a conductor and a resin insulating layer coated on the conductor. The conductor is a double twisted wire in which twisted wires formed by twisting a plurality of wires are twisted, a diameter of the wire is 0.05 mm or more and 0.2 mm or less, a cross-sectional area of the conductor is 1.0 $mm^2$ or more and 3.0 $mm^2$ or less, a breaking elongation of the conductor is 10% or more and 17% or less, a tensile strength of the conductor is 200 MPa or more and 400 MPa or less, and the insulating layer is disposed to be in close contact with the conductor and has a solid structure.

8 Claims, 4 Drawing Sheets

(51) Int. Cl.
*H01B 3/30* (2006.01)
*H01B 7/08* (2006.01)

(58) Field of Classification Search
USPC ..... 174/102 R
See application file for complete search history.

(56) References Cited

U.S. PATENT DOCUMENTS 3,681,514 A * 8/1972 Rhoades ..... H01B 7/045 174/108
4,559,200 A * 12/1985 Yamasaki ..... C22C 9/00 420/492
4,819,914 A * 4/1989 Moore ..... A01K 3/005 256/10
6,023,026 A * 2/2000 Funahashi ..... D07B 1/0673 174/128.1
6,194,663 B1 * 2/2001 Friesen ..... H01B 11/02 174/110 R
9,412,497 B2 * 8/2016 Hashimoto ..... H01B 3/302
9,748,020 B2 * 8/2017 Oshima ..... H01B 7/0009
9,875,827 B2 * 1/2018 Yoshinaga ..... C22F 1/08
10,224,130 B2 * 3/2019 Tanaka ..... H01B 3/443
10,553,332 B2 * 2/2020 Tanaka ..... H01B 7/0208
2002/0044881 A1 * 4/2002 Breedis ..... C22C 9/00 420/496
2002/0129969 A1 * 9/2002 Groegl ..... H01B 7/041 174/128.1
2004/0166017 A1 * 8/2004 Caron ..... C22C 9/06 420/492
2008/0311328 A1 * 12/2008 Kimura ..... C08K 9/06 428/36.91
2010/0147549 A1 * 6/2010 Shiina ..... H01B 7/295 174/113 C
2012/0000690 A1 * 1/2012 Van Der Meer ..... H01B 7/2825 174/102 R
2013/0092437 A1 * 4/2013 Yoshinaga ..... C22C 9/06 174/75 R
2015/0144375 A1 * 5/2015 Hashimoto ..... H01B 3/441 174/113 R
2016/0368035 A1 12/2016 Kobayashi
2017/0309370 A1 10/2017 Tanaka et al.
2018/0102199 A1 * 4/2018 Uegaki ..... H01B 5/08
2018/0182508 A1 6/2018 Tanaka et al.
2019/0198193 A1 6/2019 Tanaka et al.

FOREIGN PATENT DOCUMENTS

CN 106817914 A 6/2017
JP S54-129379 A 10/1979

* cited by examiner

CABLE HAVING A TWISTED PAIR ELECTRONIC WIRE AND A RELEASE LAYER

TECHNICAL FIELD

The present invention relates to an electronic wire and a cable.

This application claims priority based on Japanese Patent Application No. 2017-149203 filed on Aug. 1, 2017, the contents of which are incorporated herein by reference in its entirety.

BACKGROUND ART

PTL 1 discloses an electronic wire conductor for an automobile having a cross-sectional area of 0.15 to 0.5 $mm^2$ by combining sub-conductors formed of copper or copper alloy having a 0.2% proof stress of 30 to 40 $kg/mm^2$, and the conductivity of 50% IASC or more.

CITATION LIST

Patent Literature

[PTL 1] Japanese Unexamined Patent Application Publication No. 54-129379

SUMMARY OF INVENTION

An electronic wire according to an aspect of the present disclosure is an electronic wire having a conductor made of a copper or a copper alloy and a resin insulating layer coated on the conductor, in which the conductor is a double twisted wire in which twisted wires formed by twisting a plurality of wires are twisted, a diameter of the wire is 0.05 mm or more and 0.2 mm or less, a cross-sectional area of the conductor is 1.0 $mm^2$ or more and 3.0 $mm^2$ or less, a breaking elongation of the conductor is 10% or more and 17% or less, a tensile strength of the conductor is 200 MPa or more and 400 MPa or less, and the insulating layer has a solid structure disposed to be in close contact with the conductor.

A cable according to an aspect of the present disclosure includes a twisted pair electronic wire in which two of the electronic wires described above are twisted together, and a jacket coated on the twisted pair electronic wire, in which an outer peripheral surface of the jacket is a polyurethane resin.

TECHNICAL PROBLEM

The electronic wire conductor for an automobile disclosed in PTL 1 is intended to reduce the weight of the electronic wire, and has improved reliability with respect to repeated bending. For example, for electronic wires and cables used in automobiles, a further reduction in the diameter of the electronic wires is desired, and the electronic wires and cables excellent in bending resistance notwithstanding the reduced diameter are preferable.

Therefore, an objective of the present disclosure is to provide an electronic wire and a cable, which is excellent in bending resistance even when the diameter is small.

Advantageous Effects of Invention

According to the present disclosure, it is possible to provide an electronic wire and a cable which are excellent in bending resistance even when the diameter is small.

DESCRIPTION OF EMBODIMENTS

First, embodiments of the present invention will be listed and described.

An electronic wire according to an aspect of the present invention is (1) an electronic wire having a conductor and a resin insulating layer coated on the conductor, in which the conductor is a double twisted wire in which twisted wires formed by twisting a plurality of wires are twisted, a diameter of the wire is 0.05 mm or more and 0.2 mm or less, a cross-sectional area of the conductor is 1.0 $mm^2$ or more and 3.0 $mm^2$ or less, a breaking elongation of the conductor is 10% or more and 17% or less, a tensile strength of the conductor is 200 MPa or more and 400 MPa or less, and the insulating layer has a solid structure disposed to be in close contact with the conductor.

The electronic wire having the configuration described above has a good balance between tensile strength and breaking elongation, and therefore has excellent bending resistance even when the diameter is small.

A cable according to an aspect of the present invention includes (2) a twisted pair electronic wire in which two of the electronic wires in (1) described above are twisted together, and a jacket coated on the twisted pair electronic wire, in which an outer peripheral surface of the jacket is a polyurethane resin.

The cable having the configuration described above has a good balance between tensile strength and breaking elongation, and therefore has excellent bending resistance even when the diameter is small.

Description of Embodiments

Specific examples of an electronic wire and a cable according to embodiments of the present invention will be described below with reference to the drawings.

In addition, the present invention is not limited to these embodiments, but is intended to be indicated by the claim, and includes all modifications within the scope and meaning equivalent to the claims.

Figure 1:
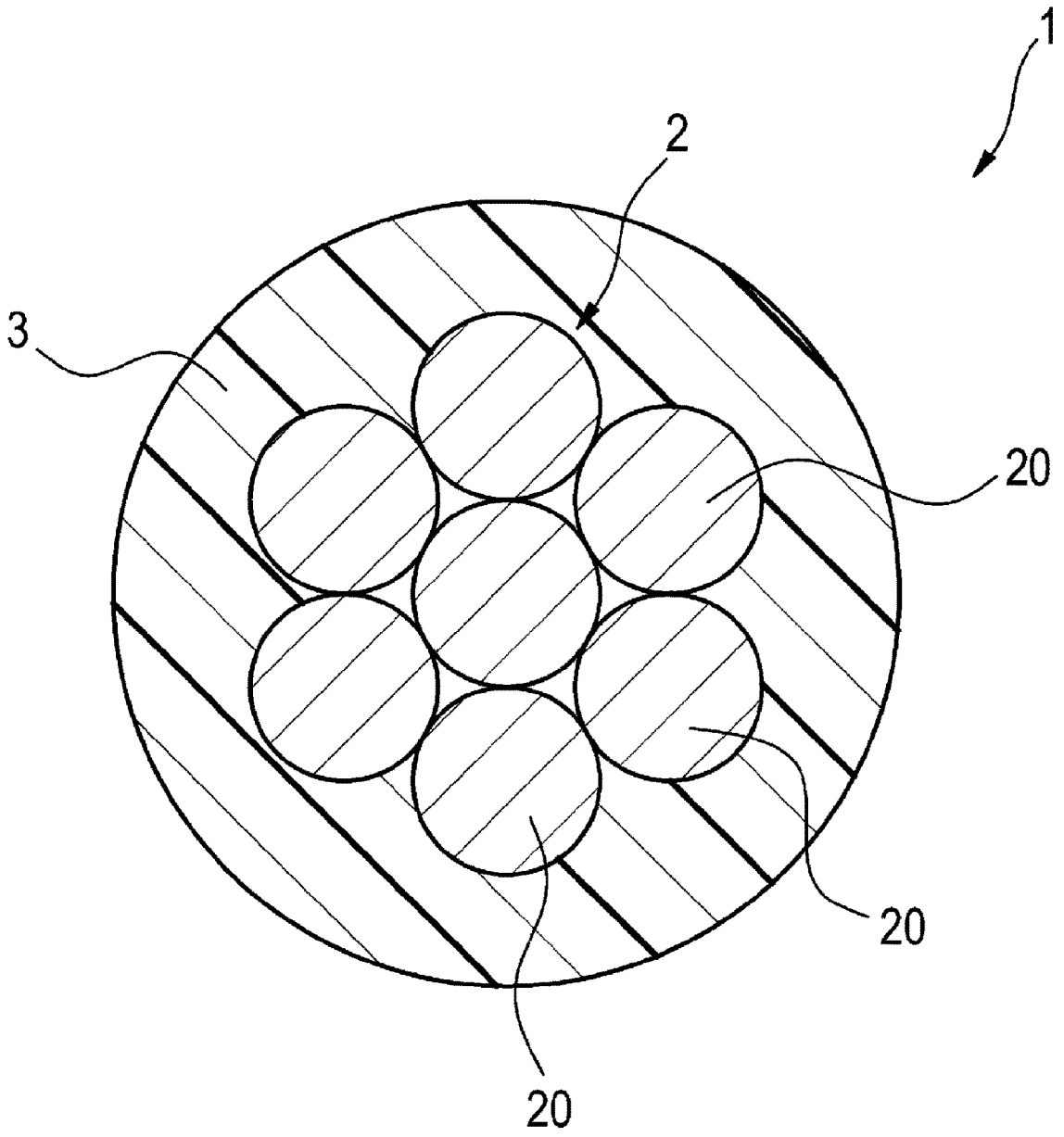
FIG. 1 is a cross-sectional view showing a configuration of an electronic wire according to an embodiment.

FIG. 1 shows an example of an electronic wire. The electronic wire 1 is used as a power supply line or a signal line for transmitting electric power to a motor or the like.

As shown in FIG. 1, the electronic wire 1 includes a conductor 2 and an insulating layer 3 provided on the outer peripheral side of the conductor 2.

The conductor 2 is formed of a plurality of (seven, in this example) small-diameter conductors 20. These small-diameter conductors 20 all have the same structure. Each of the small-diameter conductors 20 is formed as a twisted wire in which a plurality of wires formed of an annealed copper wire are twisted together, for example. The conductor 2 is formed as a double twisted wire in which seven small-diameter conductors 20 (twisted wires) are further twisted.

The diameter of a wire is 0.05 mm or more and 0.2 mm or less, for example. The number of wires forming one small-diameter conductor 20 is about 50 to 80, for example.

The cross-sectional area of the conductor 2 is 1.0 $mm^2$ or more and 3.0 $mm^2$ or less.

For a material of the wire forming the conductor 2, any material having predetermined conductivity and flexibility may be used, and a copper alloy wire may be used in addition to the copper wire described above, for example. A conductor having a breaking elongation of 10% or more and 15% or less and a tensile strength of 200 MPa or more and 300 MPa or less has a smaller breaking elongation and a higher tensile strength than a normal annealed copper wire. In order to obtain such a conductor, when manufacturing the copper for forming the conductor by annealing, the heat applied to the copper is desirably lower than when manufacturing soft copper.

In the present embodiment, the conductor is formed by using a wire that is annealed under the condition of heating at a temperature of 250 to 350° C., for 5 to 10 seconds. The conductor 2 is formed such that the elongation until the conductor 2 is broken (breaking elongation) is 10% or more and 17% or less, and is formed such that the force (tensile strength) against the tension when the conductor 2 is broken is 200 MPa or more and 400 MPa or less. Preferably, the breaking elongation is 10% or more and 15% or less and the tensile strength is 260 MPa or more and 400 MPa or less. More preferably, the breaking elongation is 10% or more and 14% or less and the tensile strength is 270 MPa or more and 350 MPa or less.

The insulating layer 3 is formed by extruded-coating on the outer periphery of the conductor 2 to be coated on the outer peripheral side of the conductor 2. The insulating layer 3 has a solid structure in which a resin material is filled between a plurality of small-diameter conductors 20 arranged on the inner side, and is coated to be in close contact with the conductor 2. Since the insulating layer 3 has a solid structure rather than a foamed layer, the conductor 2 is less likely to deform.

The insulating layer 3 is formed of a flame retardant polyolefin resin, such as, for example, a flame retardant cross-linked polyethylene to which flame retardancy is imparted by blending a flame retardant. The thickness of the insulating layer 3 is about 0.2 to 0.8 mm, and the outer diameter of the insulating layer 3 is about 1.5 to 3.6 mm. The insulating layer 3 may be formed of other materials such as ethylene-vinyl acetate copolymer resin (EVA), ethylene-ethyl acrylate copolymer resin (EEA), ethylene-methyl acrylate copolymer resin (EMA), fluorine resin, and the like.

According to the electronic wire 1 having such a configuration, since the conductor 2 has a good balance between tensile strength and breaking elongation, excellent bending resistance and twisting resistance may be obtained even when the diameter is small.

Figure 2:
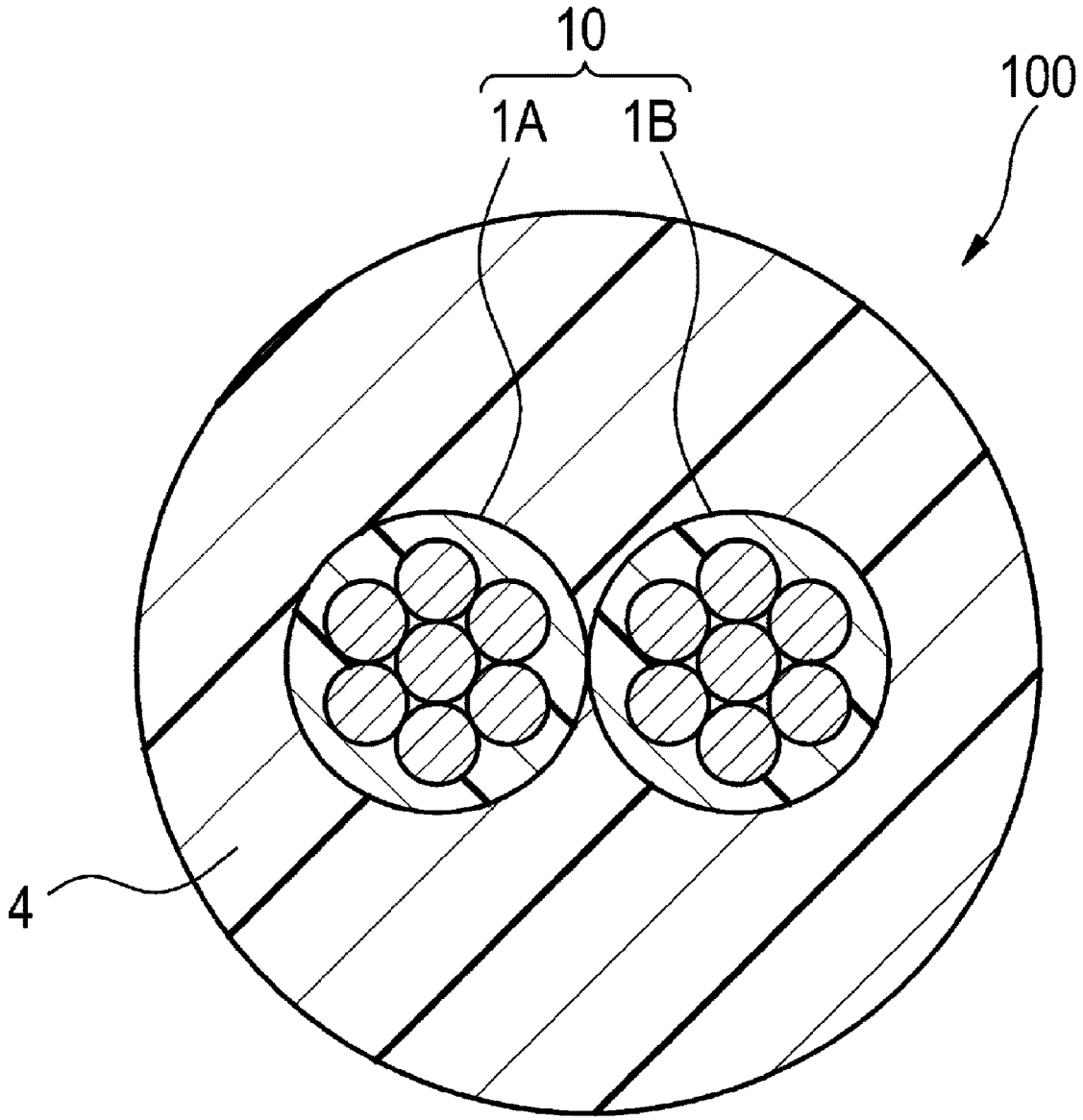
FIG. 2 is a cross-sectional view showing a configuration of a cable according to the embodiment.

FIG. 2 shows an example of a cable. The cable 100 is used as a cable for transmitting electricity to a motor or the like.

As shown in FIG. 2, the cable 100 includes a plurality of (two in this example) electronic wires 1A and 1B and a jacket 4 provided on the outer peripheral side of the electronic wires 1A and 1B. In this example, the two electronic wires are referred to as a first electronic wire 1A and a second electronic wire 1B.

The first electronic wire 1A and the second electronic wire 1B are electronic wires which have the same structure as the electronic wire 1 (see FIG. 1) described above. The first electronic wire 1A and the second electronic wire 1B are twisted together and formed as a twisted pair electronic wire 10.

The jacket 4 is formed by extruded-coating on the outer periphery of the twisted pair electronic wire 10 to be coated on the outer peripheral side of the twisted first electronic wire 1A and the second electronic wire 1B (twisted pair electronic wire 10). The jacket 4 is formed of flame retardant cross-linked polyurethane, for example. The outer diameter of the jacket 4, that is, the outer diameter of the cable 100 is about 6 to 10 mm.

In this example, the jacket 4 is formed by a single coating layer (single layer), but may be formed by a plurality of coating layers (multilayer), for example. In that case, it is preferable from the viewpoint of wear resistance that at least the outermost coating layer is formed of polyurethane resin so that the outer peripheral surface of the jacket 4 is polyurethane resin.

In order to facilitate the operation of removing the jacket 4 and taking out the first electronic wire and the second electronic wire, a release layer (not shown) may be provided between the first electronic wire and the jacket and between the second electronic wire and the jacket. For the release layer, a film may be wound, or a powder such as talc may be coated, or a thin gel layer may be provided.

According to the cable 100 having such a configuration, since the first electronic wire 1A and the second electronic wire 1B having a good balance between tensile strength and breaking elongation are used, it is possible to obtain excellent bending resistance and twisting resistance even when the diameter is small.

Figure 3:
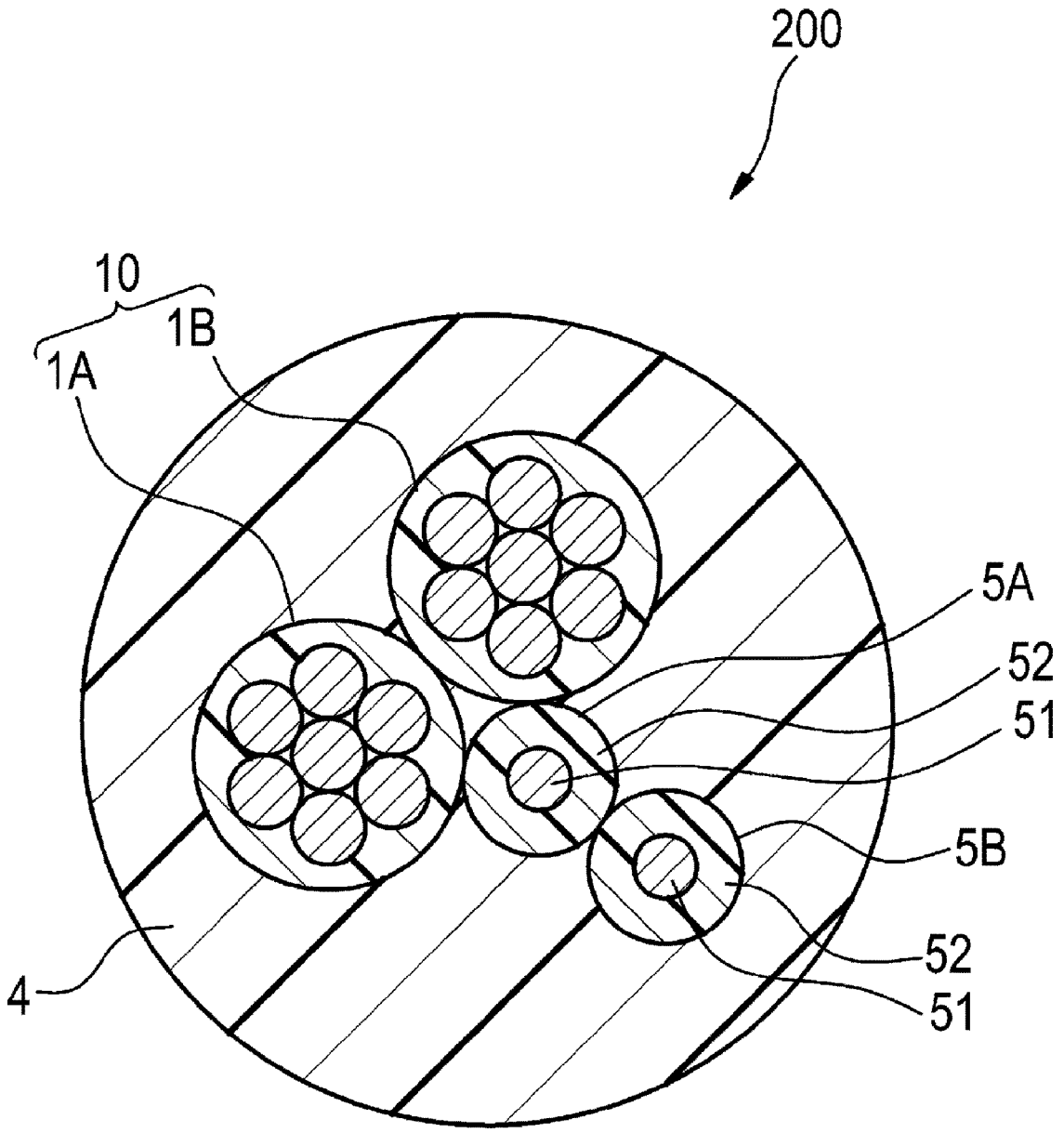
FIG. 3 is a cross-sectional view showing a configuration of a cable according to a modification of the embodiment.

FIG. 3 shows a modification of the cable 100 (see FIG. 2). Note that the parts denoted by the same reference numerals as those of the cable 100 have the same functions, and thus repeated description thereof is omitted.

As shown in FIG. 3, in addition to the first electronic wire 1A and the second electronic wire 1B forming the twisted pair electronic wire 10, the cable 200 includes a third electronic wire 5A and a fourth electronic wire 5B having a diameter smaller than those of the first electronic wire 1A and the second electronic wire 1B.

The third electronic wire 5A and the fourth electronic wire 5B each include a conductor 51, and an insulating layer 52 provided to be coated on an outer periphery of the conductor 51. The third electronic wire 5A and the fourth electronic wire 5B are electronic wires having substantially the same structure. Note that the third electronic wire 5A and the fourth electronic wire 5B may be twisted together to form a twisted pair electronic wire, or may be arranged in parallel along the length direction of the cable 200.

The conductor 51 is formed as a twisted wire in which a plurality of wires formed of an annealed copper wire are twisted together, for example. The diameter of the wire is about 0.08 mm, for example. The number of wires forming the conductor 51 is about 50 to 70, for example. The cross-sectional area of the conductor 51 is about 0.18 to 0.40 $mm^2$. The material of the wires forming the conductor 51 may be any material having predetermined conductivity and flexibility, such as a copper alloy wire formed of a copper alloy, a tin-plated annealed copper wire, and the like, in addition to the annealed copper wire described above.

The insulating layer 52 is formed of a flame retardant cross-linked polyolefin resin, for example. The thickness of the insulating layer 52 is about 0.2 to 0.4 mm, and the outer diameter of the insulating layer 52 is about 1.2 to 1.6 mm. The insulating layer 52 may be the same as the insulating layer of the electronic wire 10. Polyurethane may be used.

For example, a thick line may be used as a power supply line and a thin line may be used as a signal line. Since a thick electronic wire is weak in terms of bending resistance, only for the thick electronic wire, a conductor having a breaking elongation of 10% or more and 17% or less, and a tensile strength of 200 MPa or more and 400 MPa or less (preferably, the breaking elongation is 10% or more and 15% or less, and the tensile strength is 260 MPa or more and 400 MPa or less, and more preferably, the breaking elongation is 10% or more and 14% or less, and the tensile strength is 270 MPa or more and 350 MPa or less) may be used. Alternatively, this conductor may be used for both the thick electronic wire and the thin electronic wire.

The cable 200 having such a configuration also has the same effect as the cable 100.

The cables of the Examples 1 and 2 and Comparative Examples 1 and 2 to be described below were prepared, and the bending test and the twisting test were carried out with respect to each cable.

Example 1

In Example 1, 72 wires having an outer diameter of 0.08 mm annealed at 280° C. for 10 seconds were twisted to form a small-diameter conductor (twisted wire) 20, and seven small-diameter conductors 20 were twisted to form a double twisted wire to form a conductor 2 having a cross-sectional area of 2.5 $mm^2$. This conductor has a breaking elongation of 15% and a tensile strength of 260 MPa. Electronic wires 1 (1A and 1B) having an outer diameter of 3.2 mm was formed by coating the outer periphery of the conductor 2 with an insulating layer 3 formed of cross-linked polyethylene. The two electronic wires 1A and 1B were twisted to form a twisted pair electronic wire 10, and the outer periphery of the twisted pair wire 10 was coated with a jacket 4 formed of cross-linked polyurethane to prepare a cable 100 having an outer diameter of 8.0 mm.

Example 2

In Example 2, 52 wires having an outer diameter of 0.08 mm annealed at 280° C. for 10 seconds were twisted to form a small-diameter conductor (twisted wire) 20, and seven small-diameter conductors 20 were twisted to form a double twisted wire to form a conductor 2 having a cross-sectional area of 1.8 $mm^2$. This conductor has a breaking elongation of 14% and a tensile strength of 270 MPa. Electronic wires 1 (1A and 1B) having an outer diameter of 3.2 mm was formed by coating the outer periphery of the conductor 2 with an insulating layer 3 formed of cross-linked polyethylene. The two electronic wires 1A and 1B were twisted to form a twisted pair electronic wire 10, and the outer periphery of the twisted pair wire 10 was coated with a jacket 4 formed of cross-linked polyurethane to prepare a cable 100 having an outer diameter of 8.0 mm.

Comparative Example 1

In Comparative Example 1, a conductor and a cable having the same configuration as the cable of Example 1 were prepared using a wire of an outer diameter of 0.08 mm formed of annealed copper wire. The breaking elongation of the conductor of Comparative Example 1 was about 20%, and the tensile strength was 230 MPa.

Comparative Example 2

In Comparative Example 2, a conductor and a cable having the same configuration as the cable of Example 2 were prepared using a wire of an outer diameter of 0.08 mm formed of annealed copper wire. The breaking elongation of the conductor of Comparative Example 2 was about 20%, and the tensile strength was 230 MPa.

(Bending Test)

Figure 4:
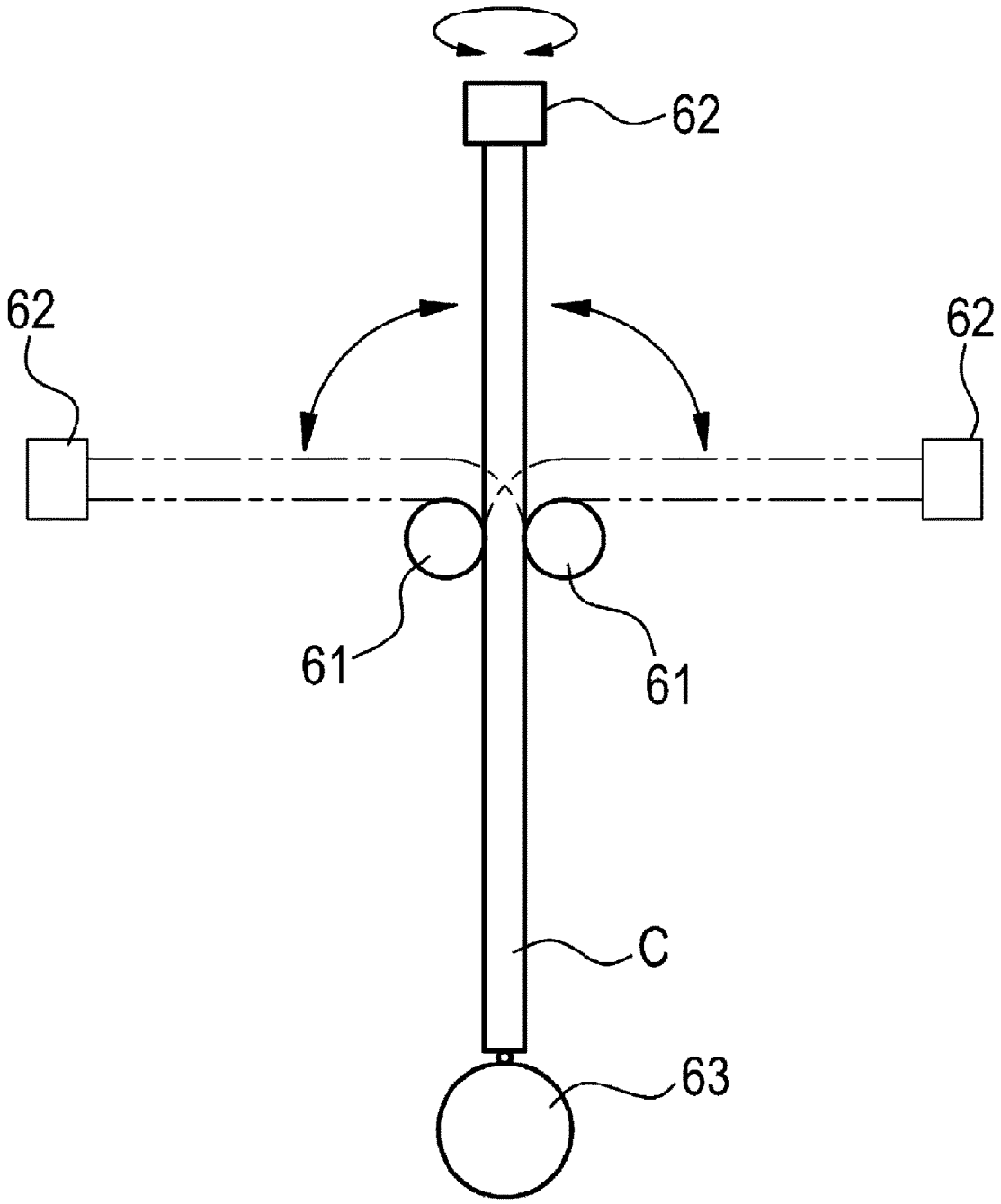
FIG. 4 is a schematic diagram of a bending test and a twisting test.

The bending resistance of the cable was evaluated in accordance with the bending test specified in ISO 14572: 2011 (E) 5.9. In this bending test, as shown in FIG. 4, the cable C was passed through between the pair of mandrels 61, the cable C was vertically suspended, the upper end of the cable C was held by the chuck 62, and a weight 63 of 5 $N/mm^2$ (5N per conductor cross-sectional area of 1 $mm^2$) was attached to the lower end thereof. By bending the chuck 62 in a pendulum shape along the circumference centered between the mandrels 61, the cable C was repeatedly bent to be −90° to +90° toward the respective mandrels 61 sides. The diameter of the mandrel 61 was 25 mm. After bending 150,000 times, the conductor forming the cable C was examined for the presence or absence of breakage.

(Twisting Test)

The mandrel 61 and the weight 63 in FIG. 4 were removed, the cable C having a length of 1000 mm was vertically suspended, and the upper end and the lower end of the cable C were held by the chucks 62, respectively. The clamp at the lower end was twisted from −90° to +90° to the left and right around the axis of the cable C. After twisting 100,000 times, the conductor forming the cable C was examined for the presence or absence of breakage.

(Test Results)

In Examples 1 and 2, no breakage of the conductor occurred after the bending test and the twisting test. On the other hand, in Comparative Examples 1 and 2, the breakage of the conductor occurred in at least one of the bending test and the twisting test. As a result, it was confirmed that Examples 1 and 2 had better resistance to bending and twisting than Comparative Examples 1 and 2.

As described above, while the present invention has been described in detail and with reference to specific embodiments thereof, it will be apparent to those skilled in the art that various changes and modifications can be made without departing from the spirit and scope of the present invention. Further, the number, the position, the shape, and the like of the above-described constituent members are not limited to the above embodiments, but can be changed to a suitable number, position, shape, and the like for implementing the present invention.

REFERENCE SIGNS LIST

1 (1A, 1B): electronic wire
2: conductor

3: insulating layer
4: jacket
5A: third electronic wire
5B: fourth electronic wire
10: twisted pair electronic wire
20: small-diameter conductor (twisted wire)
51: conductor
52: insulating layer
100, 200: cable

The invention claimed is:

1. A cable comprising:

a twisted pair electronic wire in which a first electronic wire and a second electronic wire are twisted together, each of the first electronic wire and the second electronic wire comprising:

a conductor made of a copper or a copper alloy; and a resin insulating layer coated on the conductor;

a jacket coated on the twisted pair electronic wire; and a release layer is provided between the first electronic wire and the jacket and between the second electronic wire and the jacket, wherein the conductor is a double twisted wire in which twisted wires formed by twisting a plurality of wires are twisted, a diameter of the wire is 0.05 mm or more and 0.2 mm or less, a cross-sectional area of the conductor is 1.0 $mm^2$ or more and 3.0 $mm^2$ or less, a breaking elongation of the conductor is 10% or more and 17% or less, a tensile strength of the conductor is 200 MPa or more and 400 MPa or less, and the insulating layer has a solid structure disposed to be in close contact with the conductor.

2. The cable according to claim 1, wherein an outer peripheral surface of the jacket is a polyurethane resin.

3. The cable according to claim 1, wherein the breaking elongation of the conductor is 10% or more and 15% or less, and the tensile strength of the conductor is 260 MPa or more and 400 MPa or less.

4. The cable according to claim 2, wherein the breaking elongation of the conductor is 10% or more and 15% or less, and the tensile strength of the conductor is 260 MPa or more and 400 MPa or less.

5. The cable according to claim 2, further comprising:

a third electronic wire and a fourth electronic wire having a diameter smaller than a diameter of the first electronic wire and the second electronic wire, wherein the third electronic wire and the fourth electronic wire are twisted together to form a twisted pair electronic wire.

6. The cable according to claim 2, further comprising:

a third electronic wire and a fourth electronic wire having a diameter smaller than a diameter of the first electronic wire and the second electronic wire, wherein the third electronic wire and the fourth electronic wire are arranged in parallel along the length direction of the cable.

7. The cable according to claim 2, further comprising:

a third electronic wire and a fourth electronic wire having a diameter smaller than a diameter of the first electronic wire and the second electronic wire, wherein each of the third electronic wire and the fourth electronic wire include a conductor which is formed as a twisted wire in which a plurality of wires are twisted together and an insulating layer which is provided to be coated on an outer periphery of the conductor, and the number of wires forming the conductor is 50 or more and 70 or less, a cross-sectional area of the conductor is 0.18 $mm^2$ or more and 0.40 $mm^2$ or less, a breaking elongation of the conductor is 10% or more and 15% or less, a tensile strength of the conductor is 200 MPa or more and 400 MPa or less.

8. The cable according to claim 1, wherein the breaking elongation of the conductor is 10% or more and 14% or less, and the tensile strength of the conductor is 270 MPa or more and 350 MPa or less.

* * * * *